US009851692B2

(12) United States Patent
Tsukahara

(10) Patent No.: US 9,851,692 B2
(45) Date of Patent: Dec. 26, 2017

(54) IMAGE FORMING APPARATUS HAVING A DRIVING FORCE TRANSMISSION ROTATING BODY WHICH TRANSMITS A DRIVING FORCE TO A DRIVING FORCE RECEIVING PORTION OF A DRIVEN MEMBER

(71) Applicant: CANON KABUSHIKI KAISHA, Tokyo (JP)

(72) Inventor: Takeshi Tsukahara, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/173,842

(22) Filed: Jun. 6, 2016

(65) Prior Publication Data

US 2016/0370730 A1 Dec. 22, 2016

(30) Foreign Application Priority Data

Jun. 16, 2015 (JP) ..... 2015-121163

(51) Int. Cl.
*G03G 21/18* (2006.01)

(52) U.S. Cl.
CPC ..... *G03G 21/1864* (2013.01)

(58) Field of Classification Search
CPC ..... G03G 15/0865; G03G 15/0935; G03G 21/1857; G03G 21/186
USPC ..... 399/119
See application file for complete search history.

(56) References Cited

U.S. PATENT DOCUMENTS 5,028,966 A * 7/1991 Kozuka ..... G03G 15/09 399/113
5,633,699 A * 5/1997 Aruga ..... G03G 15/757 399/107
5,745,825 A 4/1998 Okawa et al.
6,035,159 A * 3/2000 Azuma ..... G03G 15/757 399/111
6,104,895 A * 8/2000 Yokomori ..... G03G 15/0898 399/106
6,381,430 B1 * 4/2002 Yokomori ..... G03G 15/0806 399/109
2007/0147889 A1 * 6/2007 Kamimura ..... G03G 15/0813 399/119
2008/0138115 A1 * 6/2008 Chadani ..... G03G 21/186 399/167

(Continued)

FOREIGN PATENT DOCUMENTS

JP 58009171 A * 1/1983 ..... G03G 15/0935
JP 62209477 A * 9/1987

(Continued)

*Primary Examiner* — Billy Lactaoen
(74) *Attorney, Agent, or Firm* — Fitzpatrick, Cella, Harper & Scinto

(57) ABSTRACT

Provided is a technique for suppressing the occurrence of density non-uniformities in an image formed on a sheet. An image forming apparatus, which forms an image on a recording material by transmitting driving force to a cartridge, includes: a frame having a positioning portion which positions the cartridge by contacting the attached cartridge; a driving force transmission rotating body which transmits driving force by engaging with a driving force receiving portion of the driven unit; and a circumferential surface which is provided in one portion of the frame and rotatably supports the driving force transmission rotating body.

11 Claims, 7 Drawing Sheets

(56) References Cited

U.S. PATENT DOCUMENTS

| | | | | |
|---|---|---|---|---|
| 2014/0294445 | A1* | 10/2014 | Ueno | F16H 21/40<br>399/167 |
| 2016/0033026 | A1 | 2/2016 | Tsukahara et al. | |

FOREIGN PATENT DOCUMENTS

| | | | |
|---|---|---|---|
| JP | 9-179472 | A | 7/1997 |
| JP | 3211780 | B2 | 9/2001 |
| JP | 2005-99235 | A | 4/2005 |
| JP | 2007-121682 | A | 5/2007 |
| JP | 2007-298666 | A | 11/2007 |
| JP | 2009-211101 | A | 9/2009 |

* cited by examiner

SEPARATED STATE

CONTACTING STATE

IMAGE FORMING APPARATUS HAVING A DRIVING FORCE TRANSMISSION ROTATING BODY WHICH TRANSMITS A DRIVING FORCE TO A DRIVING FORCE RECEIVING PORTION OF A DRIVEN MEMBER

BACKGROUND OF THE INVENTION

Field of the Invention

The present invention relates to an image forming apparatus provided with a drive transmission mechanism for transmitting drive to a driven unit, such as a cartridge.

Description of the Related Art

Recent years have seen a requirement for image forming apparatuses, such as copying machines, laser beam printers and inkjet printers, to be capable of forming images of high definition. Therefore, the resolution of an image formed on a sheet is improved by improvement of the toner and/or intermediate transfer belt, etc. Here, there are cases where rotational non-uniformities occur in rotating bodies, such as the photosensitive drum and developing roller.

A rotational non-uniformity means a variation in the angular velocity of rotation of the rotating body. There are cases where density non-uniformities occur in the image formed on a sheet, due to the occurrence of rotational non-uniformities in the photosensitive drum, developing roller, and the like. A density non-uniformity means that the density of the image formed on the sheet is not constant.

When a very slight rotational non-uniformity has occurred in the photosensitive drum, or the like, the density non-uniformity caused in the image is often so small as to be imperceptible. However, with the recent increase in image resolution, even if a very small rotational non-uniformity has occurred in the photosensitive drum, or the like, this may be perceptible as a density non-uniformity in the image. The causes of rotational non-uniformities are considered to be eccentricity in the rotating bodies, such as the photosensitive drum, the developing roller and the gears.

Eccentricity occurs in a rotating body due to divergence or inclination, etc. of the rotational center axis of the rotating body, which means that driving force is not transmitted accurately from the drive source to the rotating body and variations may occur in the angular velocity of rotation of the rotating body. In other words, it is necessary to reduce rotational non-uniformities in order to suppress density non-uniformities occurring in the image.

In order to resolve this problem, in Japanese Patent No. 3211780, bearings which support a rotary shaft of a gear that transmits drive to a photosensitive drum, or the like, and a frame which supports the bearings, are formed integrally. More specifically, burring is provided on a metal frame, and by using the burring as the bearings, the rotational accuracy of the gear is improved. If the frame and bearings are formed as separate members, then the rotational accuracy of the gear deteriorates due to error in the positioning of the bearings with respect to the frame.

However, by unifying the frame and bearings in an integrated body, it is possible to improve the rotational accuracy of the gear, accordingly, without the occurrence of any positioning errors of the bearings with respect to the frame. Here, in Japanese Patent No. 3211780, a process cartridge having a rotating body, such as a photosensitive drum, is positioned in a frame that is separate from the frame in which the burring is formed. The frame in which the burring is formed, and the frame in which the process cartridge is positioned are then coupled by screws, or the like.

Furthermore, conventionally, a drive transmission mechanism 100 such as that shown in FIG. 7 is known. The drive transmission mechanism 100 has a frame 101, a bearing 102, a drive transmission member 106 and a drive coupling member 107. Drive which is transmitted to the drive transmission member 106 from drive means (not illustrated) is transmitted to the drive coupling member 107, and is transmitted to a supply roller 115 from the drive transmission member 106 via the drive receiving member 111. The drive coupling member 107 which transmits the drive to a driven unit 110 is supported rotatably by a bearing 102 attached on the frame 101.

However, in Japanese Patent No. 3211780, a process cartridge having a rotating body, such as a photosensitive drum, is positioned in a frame that is separate from the frame in which the burring is formed. Therefore, the rotational accuracy of the photosensitive drum, and the like, provided in the process cartridge, declines to the extent that error occurs in the positioning of the frame in which the process cartridge is supported and the frame in which the burring is formed. Consequently, there is a risk of density non-uniformities in the image formed on the sheet.

SUMMARY OF THE INVENTION

It is an object of the present invention to provide a technique for suppressing the occurrence of density non-uniformities in an image formed on a sheet.

An object of the present invention is to provide an image forming apparatus in which a cartridge is attached and which forms an image on a recording material by transmitting driving force to the cartridge, the image forming apparatus comprising:

a frame having a positioning portion which positions the cartridge by contacting the cartridge;

a driving force transmission rotating body which transmits driving force by engaging with a driving force receiving portion of the cartridge; and a circumferential surface which is provided on the frame and rotatably supports the driving force transmission rotating body.

Further features of the present invention will become apparent from the following description of exemplary embodiments with reference to the attached drawings.

DESCRIPTION OF THE EMBODIMENTS

Embodiments of the present invention are described below with reference to the drawings. The dimensions, materials, shapes and relative positions, and the like, of the constituent parts described in these embodiments should be changed appropriately depending on the composition and various conditions of the apparatus to which the invention is applied, and it is not intended to limit the scope of the invention to the description of the embodiments given below.

(First Embodiment)

<Configuration of Image Forming Apparatus>

Figure 1:
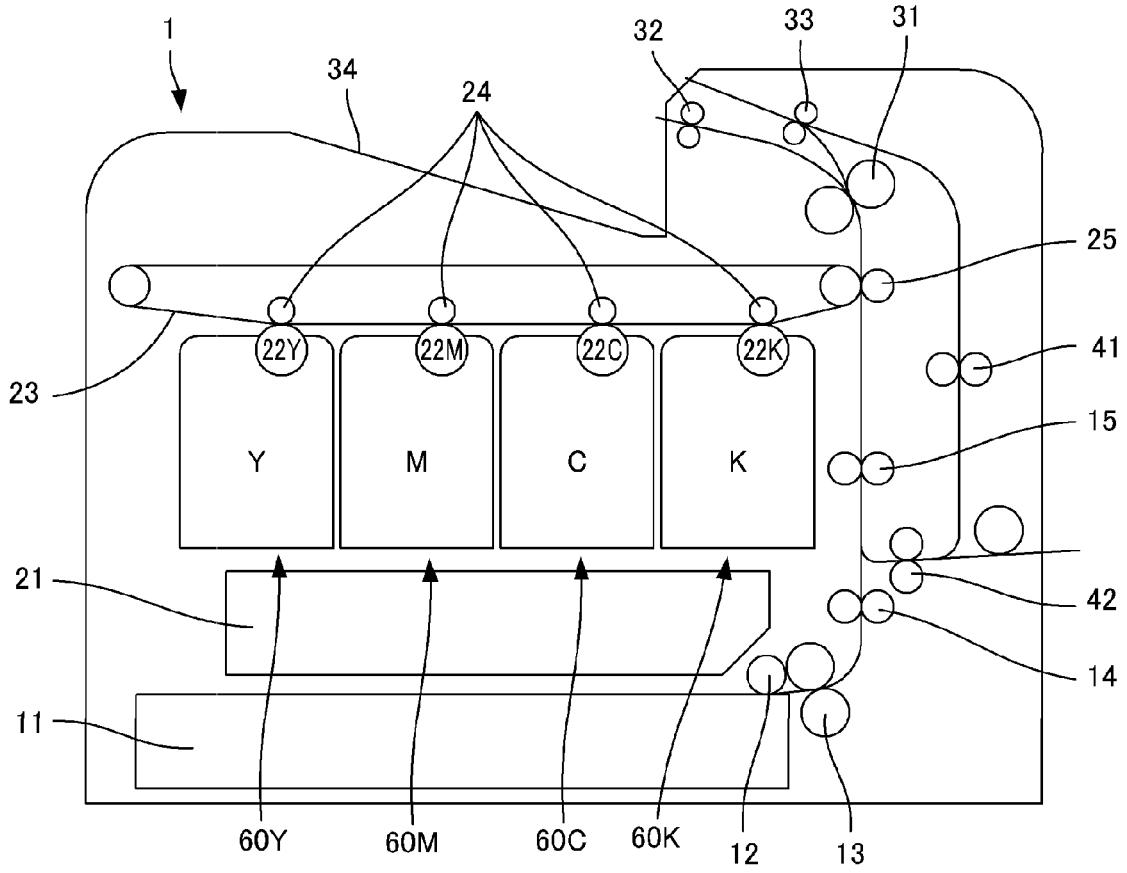
FIG. 1 is a schematic cross-sectional diagram of an image forming apparatus relating to a first embodiment.

FIG. 1 is a schematic cross-sectional diagram of an image forming apparatus 1 relating to the present embodiment. Firstly, the general configuration of the image forming apparatus 1 will be described with reference to FIG. 1. The image forming apparatus 1 is a color laser printer, and a cassette 11 loaded with recording paper is provided in the lower portion of the image forming apparatus 1 so as to be insertable in an apparatus main body. The recording paper loaded in the cassette 11 is separated and paid out, one sheet at a time, by a pick-up roller 12 and paper supply roller 13, and is conveyed by a conveyance roller pair 14 and a conveyance roller pair 15 towards a secondary transfer roller 25. Furthermore, the conveyance roller pair 15 has a registration function for synchronizing the toner image formed on the intermediate transfer belt 23, and the recording material.

Moreover, the image forming apparatus 1 has four process cartridges 60 (60Y, 60M, 60C, 60K) (driven units) which can be attached in and removed from the apparatus main body of the image forming apparatus 1. In FIG. 1, the process cartridges 60 are, arranged in order from the left-hand side, a process cartridge 60Y (yellow), a process cartridge 60M (magenta), a process cartridge 60C (cyan) and a process cartridge 60K (black). Here, in the present embodiment, the configuration of the process cartridges 60Y to 60K is the same, apart from the color of the toner held therein, and therefore unless specifically necessary below, the suffixes Y, M, C and K are omitted below.

The scanner 21 forms an electrostatic latent image on a photosensitive drum 22 (22Y to 22K) by irradiating the photosensitive drum 22, which has been charged by a charging roller, with a laser. Furthermore, the toner held inside the process cartridge 60 is supplied to a developing roller 66 (developer carrying member) by a supply roller 65 (65Y to 65K) which is a supply member (see FIG. 2A and FIG. 2B). The developing roller 66 carries toner. A developing bias is applied between the developing roller 66 and the photosensitive drum 22, and the toner carried on the developing roller 66 is supplied to the photosensitive drum 22, thereby developing the electrostatic latent image on the photosensitive drum 22.

The toner images formed on the photosensitive drums 22 are primarily transferred onto the intermediate transfer belt 23 by the application of a bias to the primary transfer rollers 24 (24Y to 24K). The toner images are then conveyed to a secondary transfer position, in a state where the toner images of four colors have been superimposed on each other on the intermediate transfer belt 23. Furthermore, the toner image of four colors on the intermediate transfer belt 23 is transferred secondarily onto the recording material by a secondary transfer roller 25, at the secondary transfer position. The toner image transferred secondarily onto the recording material is fixed to the recording material by being heated and pressurized by the fixing roller 31.

The recording material on which the toner image has been fixed is then discharged to a paper discharge tray 34 situated outside the image forming apparatus 1, by a discharge roller 32. Furthermore, when forming an image on both surfaces of the recording material, the recording material is switched back by a reversal roller 33, and is conveyed again to the conveyance roller pair 15 by the conveyance roller pair 41 and the conveyance roller pair 42. An image is then formed on the rear surface of the recording material, by a similar procedure to that for forming an image on the front surface of the recording material. The recording material having an image formed on the rear surface thereof is then discharged to a paper discharge tray 34.

<Configuration of Process Cartridge>

Figure 2B:
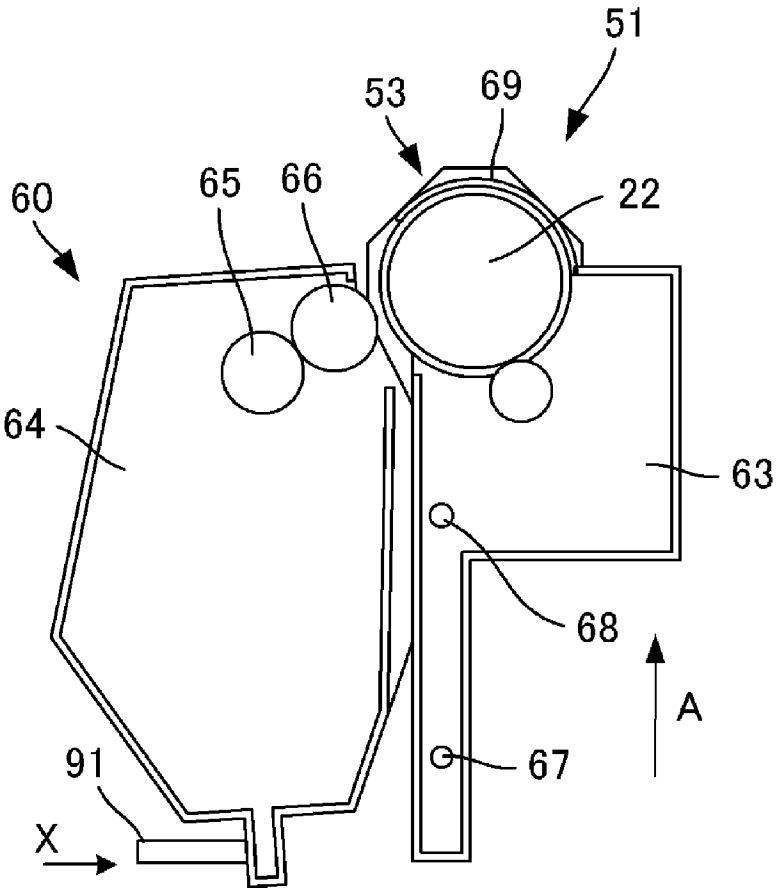
FIG. 2B is a schematic cross-sectional diagram of a process cartridge according to the first embodiment.
Figure 2A:
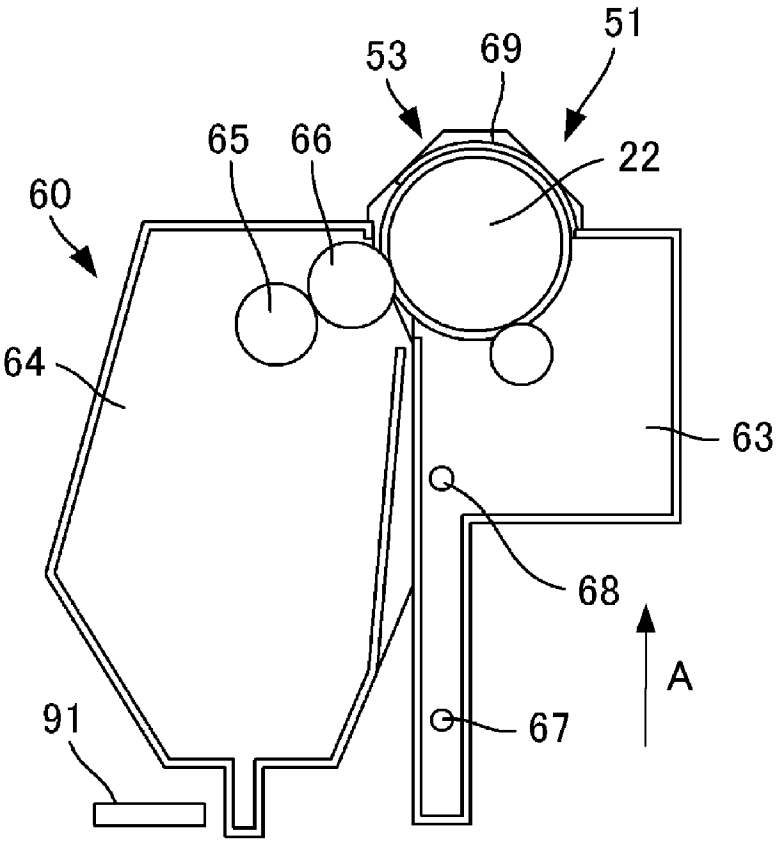
FIG. 2A is a schematic cross-sectional diagram of a process cartridge according to a first embodiment.

Next, the configuration of the process cartridge 60 will be described with reference to FIG. 2A and FIG. 2B. FIG. 2A and FIG. 2B are schematic cross-sectional drawings of a process cartridge 60 viewed in the direction of the axis of rotation of the photosensitive drum 22. As shown in FIG. 2A, the process cartridge 60 has a photosensitive body unit 63 having a photosensitive drum 22, and a developing unit 64 having a developing roller 66 and a supply roller 65. The image forming apparatus 1 is provided with a frame 51, which is one portion of the framework of the apparatus. The frame 51 is a plate-shaped metal member (metal plate) which extends in the vertical direction and in the direction of arrangement of the plurality of photosensitive drums 22. The photosensitive drum 22 is positioned with respect to the frame 51 by being pressed by pressing means (not illustrated) in the direction of arrow A towards a positioning portion 53 of the frame 51, via a bearing 69 (bearing member) for the photosensitive drum 22. The photosensitive body unit 63 is registered in position by fitting together of a rotation stopping portion 67, which is a fitting portion, and a fit receiving portion (not illustrated) which is provided in the frame 51. Furthermore, the developing unit 64 is supported rotatably about a swinging shaft 68, with respect to the photosensitive body unit 63.

The developing roller 66 is impelled by impelling means (not illustrated) in a direction towards the photosensitive drum 22. When developing the electrostatic latent image on the photosensitive drum 22, the developing roller 66 makes contact with the photosensitive drum 22, as shown in FIG. 2A. On the other hand, when not developing the electrostatic latent image on the photosensitive drum 22, as shown in FIG. 2B, the photosensitive drum 22 and the developing roller 66 are set to a separated state, due to the developing unit 64 being pressed in the X direction by a separating member 91.

Figure 3:
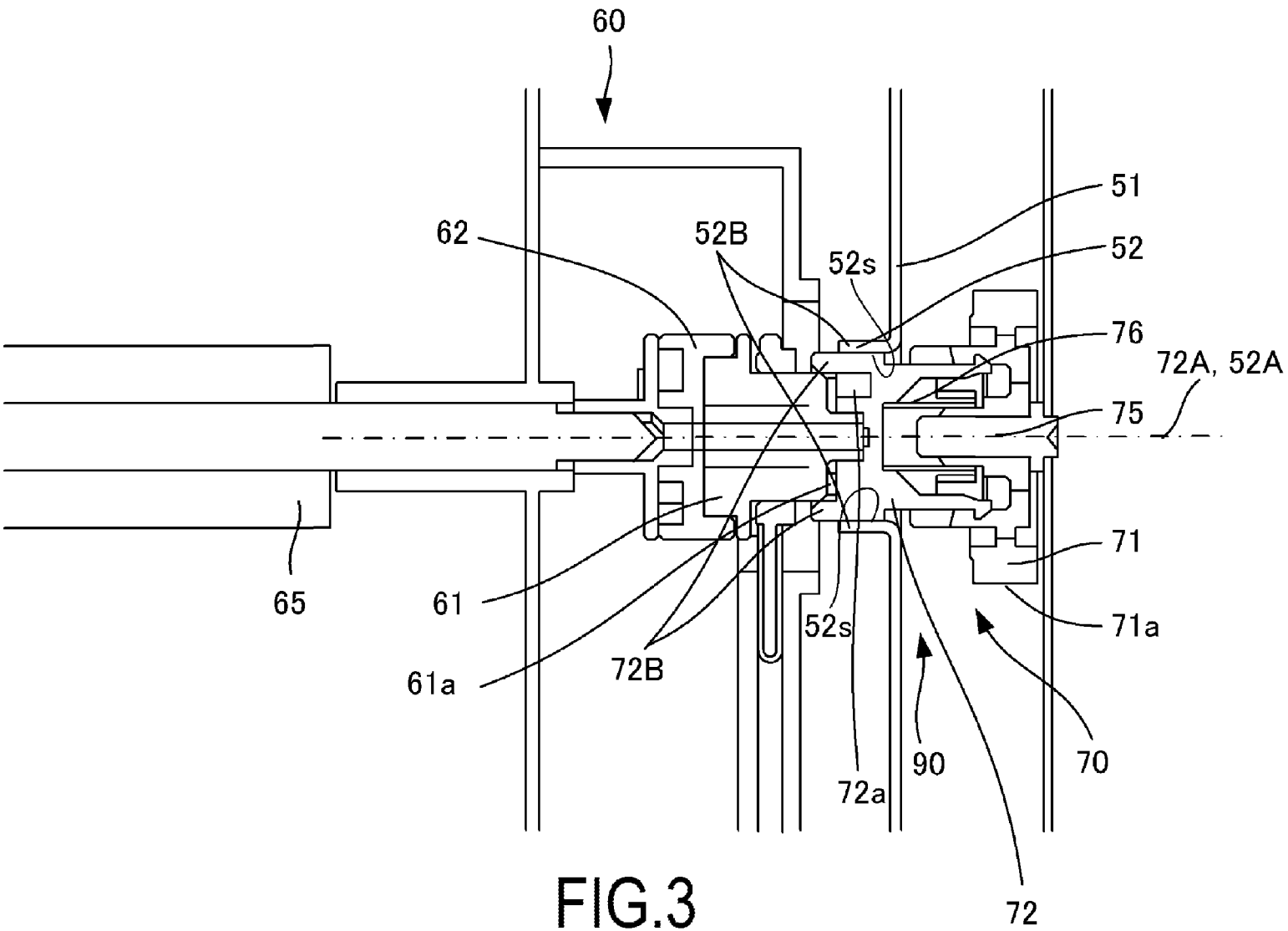
FIG. 3 is a cross-sectional drawing illustrating a mechanism for transmitting driving force to the process cartridge according to the first embodiment.

FIG. 3 is a cross-sectional diagram of the developing unit 64 and the drive transmission mechanism 90 of the image forming apparatus 1, as viewed in a direction perpendicular to the direction of the axis of rotation of the supply roller 65. In the developing unit 64, as shown in FIG. 3, the drive transmitted to the drive receiving member (driving force receiving portion) 61 can be transmitted to the supply roller 65 via a joint 62. The driving force transmitted to the supply roller 65 is transferred to the developing roller 66 via a gear (not illustrated).

When an electrostatic latent image on the photosensitive drum 22 is not being developed in the process cartridge 60 as described above, then the photosensitive drum 22 and the developing roller 66 are separated from each other. It will now be explained why it is necessary to separate the photosensitive drum 22 and the developing roller 66. If a toner image is formed on the photosensitive drum 22, firstly, the photosensitive drum 22 rotates in a state where the photosensitive drum 22 and the developing roller 66 are separated. The photosensitive drum 22 is irradiated with a laser from the scanner 21, thereby forming an electrostatic latent image on the photosensitive drum 22.

Next, the developing roller 66 is made to contact the photosensitive drum 22, in a state where the developing roller 66 and the supply roller 65 are rotating. By applying a bias to the developing roller 66 in a state where the photosensitive drum 22 and the developing roller 66 are in contact with each other, the electrostatic latent image on the photosensitive drum 22 is developed. Here, the photosensitive drum 22 and the developing roller 66 rotate at different speeds of rotation. Therefore, when the rotating photosensitive drum 22 and the rotating developing roller 66 make contact, rubbing occurs between the photosensitive drum 22 and the developing roller 66, leading to abrasion and wearing of the photosensitive drum 22 and the developing roller 66. This abrasion and wearing shorten the life of the photosensitive drum 22 and the developing roller 66. Consequently, by reducing the rubbing time between the photosensitive drum 22 and the developing roller 66, it is possible to lengthen the life of the photosensitive drum 22 and the developing roller 66. Therefore, the photosensitive drum 22 and the developing roller 66 are separated when not developing an electrostatic latent image.

However, since the photosensitive drum 22 and the developing roller 66 may be in a separated state, then there may be cases where drive is transmitted to the developing roller 66 in this separated state. When the photosensitive drum 22 and the developing roller 66 are in a separated state, the positions of the rotational center axis 72A of the drive coupling member (driving force transmission rotating body) 72 (see FIG. 3) and the rotational center axis of the supply roller 65 deviate while maintaining a parallel relationship. The joint 62 is provided in the process cartridge 60 in such a manner that drive is transmitted to the supply roller 65 even in this state. In the present embodiment, an Oldham coupling is used as the joint 62, but the joint 62 may also be a disk coupling, or the like. Here, as shown in FIG. 3, the process cartridge 60 has a drive receiving member 61 and a joint 62. The drive receiving member 61 has a driving force receiving portion 61*a*, and by engagement of the driving force receiving portion 61*a* and the drive coupling portion 72*a* of the drive coupling member 72, drive is transmitted from the drive coupling member 72 to the drive receiving member 61. The joint 62 can transmit drive from the drive coupling member 72 to the supply roller 65, even if there is deviation between the rotational center axis 72A of the drive coupling member 72 and the rotational center axis of the supply roller 65.

<Configuration for Transmitting Drive to Process Cartridge>

Figure 4:
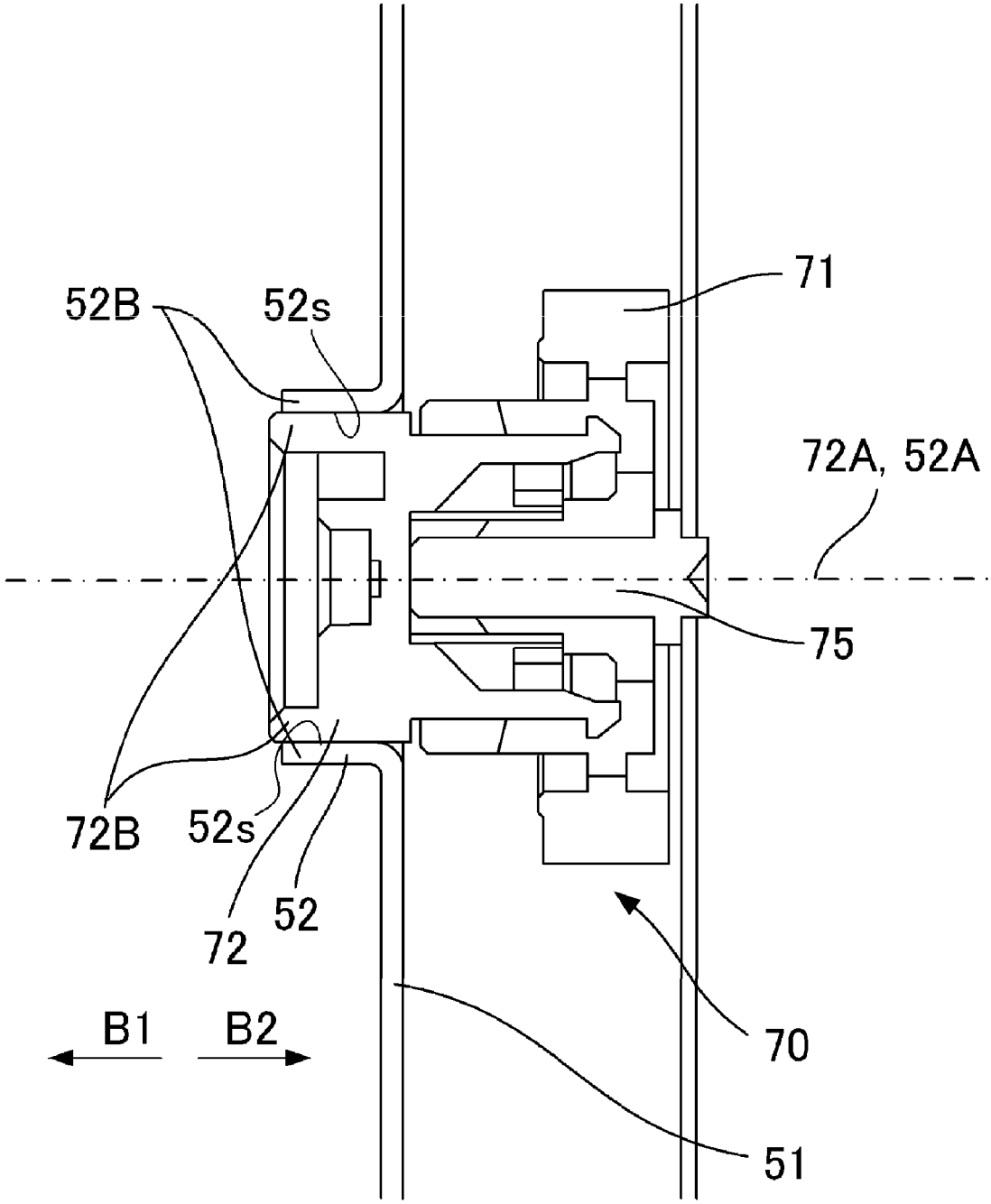
FIG. 4 is a cross-sectional diagram showing the state of a rotating body in a case where the process cartridge has been removed.
Figure 5:
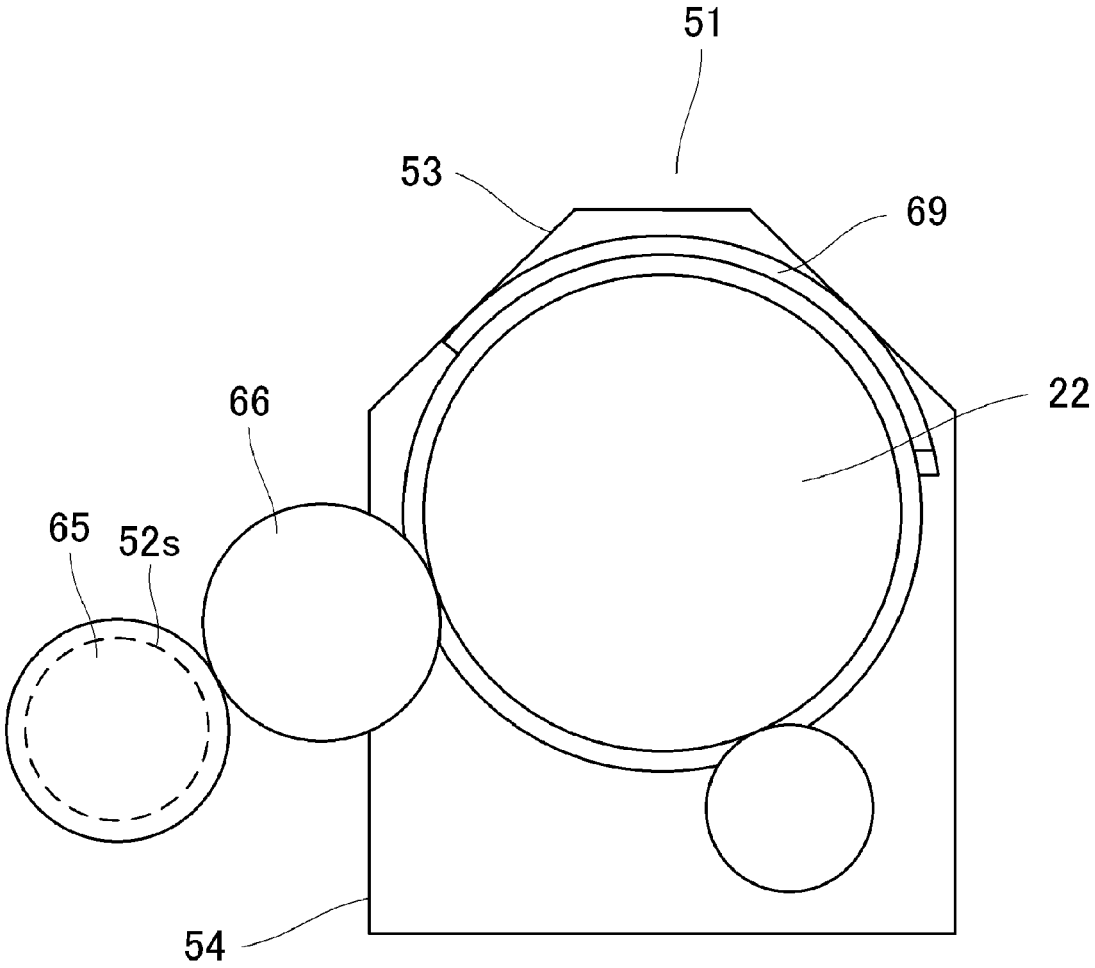
FIG. 5 is a diagram showing a state where an image bearing member has been positioned on the frame.

Next, the mechanism for transmitting drive to the process cartridge 60 will be described with reference to FIG. 3 to FIG. 5. FIG. 3 is a cross-sectional drawing illustrating a mechanism for transmitting driving force to the process cartridge 60 according to a first embodiment of the invention. FIG. 4 is a cross-sectional diagram showing the state of a drive input rotating body 70 in a case where the process cartridge 60 has been removed. FIG. 5 is a diagram showing a state where the photosensitive drum 22 has been positioned on the frame 51.

As shown in FIG. 3, the drive transmission mechanism 90 includes the frame 51, a cylindrical projecting portion 52 which is provided to project in the main body portion of the frame 51, and the drive input rotating body 70 which is supported rotatably on the projecting portion 52. Furthermore, the drive input rotating body 70 includes the drive transmission member 71 and the drive coupling member 72. The drive transmission member 71 has a drive transmission portion 71*a*, which is a gear tooth surface, and the drive coupling member 72 has a drive coupling portion 72*a* for transmitting drive to the process cartridge 60.

When drive means (not illustrated) is driven, driving force is transmitted to the drive transmission member 71 due to a gear (not illustrated) engaging with the drive transmission portion 71*a*. Due to the engagement of the drive transmission member 71 and the drive coupling member 72, the driving force transmitted to the drive transmission member 71 is transmitted to the drive coupling member 72. A groove (not illustrated) is provided in the drive transmission member 71, and a rib (not illustrated) is provided in the drive coupling member 72. The rib provided in the drive coupling member 72 engages with the groove provided in the drive transmission member 71, whereby the driving force is transmitted from the drive transmission member 71 to the drive coupling member 72.

The driving force transmitted to the drive coupling member 72 is transmitted to the drive receiving member 61. A groove-shaped drive coupling portion 72*a* is provided in the drive coupling member 72, and a driving force receiving portion 61*a*, which is a rib, is provided in the drive receiving member 61. Due to the drive coupling portion 72*a* provided on the drive coupling member 72 engaging with the driving force receiving portion 61*a* provided on the drive receiving member 61, driving force is transmitted from the drive coupling member 72 to the drive receiving member 61. Furthermore, similarly, a rib (not illustrated) is provided on the drive receiving member 61 and a groove (not illustrated) is provided in the joint 62. The rib provided on the drive receiving member 61 engages with the groove provided in the joint 62, whereby the driving force is transmitted from the drive receiving member 61 to the drive joint 62.

In this way, in the present embodiment, the drive input rotating body 70 includes the drive transmission member 71 and the drive coupling member 72. Here, the drive transmission member 71 is positioned by a shaft 75, and the drive coupling member 72 is positioned by the projecting portion 52. Supposing that the drive transmission member 71 and the drive coupling member 72 are formed by a single member as the drive input rotating body 70, then if there is deviation in the position where the axis of rotation of the drive input rotating body 70 is supported, the drive input rotating body 70 is rotated in an inclined state.

When the drive input rotating body 70 is rotated in an inclined fashion, rotational non-uniformities occur in the supply roller 65, since the drive ceases to be transmitted satisfactorily from the drive input rotating body 70 to the drive receiving member 61, and there is a risk of deterioration in the image quality. However, in the present embodiment, the drive input rotating body 70 is configured by mutual engagement of separate members, namely, the drive transmission member 71 and the drive coupling member 72. Due to the occurrence of play between the drive transmission member 71 and the drive coupling member 72, it is possible to transmit drive from the drive transmission member 71 and the drive coupling member 72, without inclination of the drive transmission member 71. Consequently, it is possible to suppress inclination of the tooth surface of the drive transmission portion 71*a* (gear) in the drive transmission member 71, and therefore it is possible to suppress rotational non-uniformities occurring due to intermeshing of the tooth surfaces of the gears.

Here, in the first embodiment, a cylindrical projecting portion 52 is formed in the frame 51. The cylindrical projecting portion 52 supports the drive coupling member 72 in a rotatable fashion. Furthermore, the central axis 52A of the cylindrical projecting portion 52 coincides with the rotational center axis 72A of the drive coupling member 72. The circumferential surface 52*s* of the cylindrical projecting portion 52 supports the drive coupling member 72 rotatably about the rotational center axis 72A. As shown in FIG. 3, the circumferential surface 52*s* is the inner circumferential surface of the cylindrical projecting portion 52. In the present embodiment, the projecting portion 52 is formed on the frame 51 by which the photosensitive drum 22 is positioned in the process cartridge 60. Furthermore, the frame 51 and the projecting portion 52 are made from a metallic material. The material of the frame 51 is not necessarily limited to this. The frame 51 and the projecting portion 52 may be, for example, made from a resin material which has excellent strength and heat resistance. For example, the frame 51 may be made from a polymer alloy material including a polycarbonate resin and an acrylonitrile butadiene styrene (ABS) resin.

Furthermore, in the present embodiment, as described above, the frame 51 is made from a metallic material. Consequently, it is possible to improve the heat conductivity of the frame 51, compared to a case where the frame 51 is made from a resin material. In the present embodiment, the photosensitive drum 22 and the developing roller 66 are in a separated state in the process cartridge 60, except when forming an image. In this separated state, drive is transmitted from the drive coupling member 72 to the supply roller 65, in a state where there is great deviation between the central axes of rotation of the drive coupling member 72 and the supply roller 65. Consequently, a load is applied to the drive coupling member 72 in a direction perpendicular to the direction of the rotational center axis of the drive coupling member 72.

Furthermore, in recent years, the speed of image formation in an image forming apparatus 1 has been increasing. In accordance with this, the speed of rotation of the drive coupling member 72 has become dramatically faster. When the load on the drive coupling member 72 and the speed of rotation of the drive coupling member 72 are high, abrasion and wear occurs in the drive coupling member 72 due to increase in the temperature of the rubbing portions of the drive coupling member 72 and the projecting portion 52, as a result of the heat of friction.

Furthermore, if the frame 51 is made from resin, there is a risk of burning of the frame 51 if the temperature in the rubbing portions of the drive coupling member 72 and the projecting portion 52 becomes higher than the thermal resistance temperature of the resin. Consequently, by forming a frame 51 from a material having a high thermal conductivity, such as a metal, the heat radiating properties are raised in the rubbing portions of the drive coupling member 72 and the projecting portion 52, and the occurrence of abrasion or wear, or burning, etc. in the frame 51, can be suppressed. Furthermore, although a large load is applied to the projecting portion 52, by using a metallic plate material which has greater rigidity than a resin material as the material of the frame 51, it is possible to suppress the occurrence of elastic deformation and/or creep in the projecting portion 52, and to position the drive coupling member 72 accurately.

Furthermore, in the present embodiment, the cylindrical projecting portion 52 is formed by a burring process. The drive transmission member 71 is supported rotatably by the shaft 75, and furthermore, the drive coupling member 72 is supported movably in the direction of the rotational center axis of the drive coupling member 72. The drive coupling member 72 is disposed on the side nearer to the process cartridge 60 than the drive transmission member 71 (the side of the driven unit). Furthermore, an impelling member 76 is attached on the drive transmission member 71 and the drive coupling member 72, thereby impelling the drive coupling member 72 towards the process cartridge 60.

Next, the positional relationship between the drive coupling member 72 and the projecting portion 52 in a state where the process cartridge 60 has been removed from the image forming apparatus 1 will be described. FIG. 4 is a cross-sectional drawing showing the vicinity of the drive coupling member 72, when the process cartridge has been removed, as viewed in a direction perpendicular to the rotational center axis 72A. The process cartridge 60 is removed from the image forming apparatus 1 in a direction B1 parallel to the rotational center axis 72A, away from the drive transmission member 71 with respect to the frame 51.

Here, the drive coupling member 72 can be moved with respect to the projecting portion 52, in the direction of the rotational center axis 72A of the drive coupling member 72. In FIG. 4, the drive coupling member 72 can be moved in the direction of B1 and the direction of B2 which is opposite to B1. When the process cartridge 60 and the drive coupling member 72 are in an engaged state, then as shown in FIG. 3, the drive coupling member 72 moves in the direction of B1, and thereby moves to the side where the drive receiving member 61 of the process cartridge 60 is disposed. In a state where the drive coupling member 72 has been moved to the side where the drive receiving member 61 of the process cartridge 60 is disposed, the drive coupling member 72 and the drive receiving member 61 can be engaged with each other. Due to the drive coupling member 72 moving in the direction B1 when the process cartridge 60 has been attached on the image forming apparatus 1, the drive coupling member 72 moves towards the process cartridge 60, and the driving force receiving portion 61*a* and the drive coupling portion 72*a* engage with each other.

Furthermore, as shown in FIG. 4, the drive coupling member 72 can also be moved in a direction B2 which is opposite to the side where the process cartridge 60 is disposed. When the process cartridge 60 is removed from the image forming apparatus 1, as shown in FIG. 4, the drive coupling member 72 moves in the direction B2, moves towards the drive transmission member 71, and abuts against the shaft 75. In the present embodiment, even if the drive coupling member 72 has moved to the side of the drive transmission member 71, as shown in FIG. 4, the drive coupling member 72 still projects out to the side where the drive receiving member 61 of the process cartridge 60 is disposed (the downstream side in direction B1), beyond the front end of the projecting portion 52, in the direction of the rotational center axis 72A. Here, the end portion of the drive coupling member 72 on the side where the drive receiving member 61 of the process cartridge 60 is disposed, in the direction of the rotational center axis 72A of the drive coupling member 72, is called end portion 72B. In the present embodiment, in the direction of the rotational center axis 72A of the drive coupling member 72, the end portion 72B is positioned closer to the side where the drive receiving member 61 of the process cartridge 60 is disposed (the downstream side in direction B1), than the front end 52B of the projecting portion 52 in the direction of the central axis 52A of the projecting portion 52 is positioned.

In the present embodiment, when the process cartridge 60 is removed from the image forming apparatus 1, a user may directly touch the drive coupling member 72 or the cylindrical projecting portion 52, etc. Therefore, it is desirable if the frame 51 is made from a hard material, such as a metallic material, thereby making the user less liable to touch the edges of the front end 52B of the cylindrical projecting portion 52.

Furthermore, the drive coupling member 72 can be moved between a transmission position, which is a position for when transmitting drive by engaging with the drive receiving member 61, and a retracted position, which is a position withdrawn (moved) in the B2 direction (a direction away from the drive receiving member 61), from the transmission position. Furthermore, at least the surface of the drive coupling member 72 is made from a resin material. However, as shown in FIG. 4, even in a state where the drive coupling member 72 is situated in the retracted position, the drive coupling member 72 projects towards the drive receiving member 61 in the process cartridge 60, with respect to the front end 52B of the projecting portion 52, in the direction of the rotational center axis 72A. Consequently, it is possible to make the user less liable to touch the edges of the front end 52B of the projecting portion 52.

Next, the positional relationship between the components that constitute the process cartridge 60, and the frame 51, will be described. FIG. 5 is a diagram showing a state where the photosensitive drum 22 has been positioned on the frame 51, and the developing roller 66 has been placed in contact with the photosensitive drum 22. As described above, the photosensitive drum 22 is positioned with respect to the frame 51 by abutting against the positioning portion 53 in the frame 51 via the bearing 69 for the photosensitive drum 22. A cutaway region (cutaway hole) 54 which is larger than the bearing 69 for the photosensitive drum 22 is formed in the frame 51, which is made of plate metal. The cutaway portion 54 is a portion which is cut out from the frame 51. The edge of the cutaway portion 54 forms a positioning portion 53. In other words, in the present embodiment, the photosensitive drum 22 in the process cartridge 60 is positioned on the frame 51, and the projecting portion 52 is formed integrally with a portion of the frame 51. The circumferential surface 52*s* of the projecting portion 52 indicated by the dotted line in FIG. 5 is a circumferential surface which is coaxial with the supply roller 65.

In this way, in the present embodiment, the process cartridge 60 is positioned by the positioning portion 53 in the frame 51, and the drive coupling member 72 is supported rotatably by the projecting portion 52 in the frame 51. By supporting the drive coupling member 72 on the frame 51 which positions the process cartridge 60, without any other intervening components, it is possible to improve the positioning accuracy of the drive coupling member 72 with respect to the process cartridge 60.

Consequently, it is possible to suppress deviation between the rotational center axis of the drive receiving member 61 in the process cartridge 60 and the rotational center axis 72A of the drive coupling member 72, and rotational non-uniformity in the rotating body that is used in the process cartridge 60 can be suppressed. Furthermore, by supporting the drive coupling member 72 with the frame 51, without an intervening bearing, then it is possible to reduce the number of components used in the image forming apparatus 1 and the costs can be lowered.

Since rotational non-uniformity of the rotating body used in the process cartridge 60 can be suppressed, it is possible to effectively suppress density non-uniformity in the image formed on the recording medium. In the process cartridge 60, density non-uniformities are liable to occur in the image, if rotational non-uniformity occurs in the rotating body used when forming the electrostatic latent image on the photosensitive drum 22, when developing the electrostatic latent image, or when transferring the developer image. Furthermore, in general, the drive transmission mechanism which transmits drive to the process cartridge 60 and/or intermediate transfer belt 23, and the like, has a greater effect on the density non-uniformity of the image, than the mechanisms used in the paper supply device which supplies the recording material, or the fixing device which fixes the toner image on the recording medium, and the like. However, in the present embodiment, since the rotational non-uniformity can be suppressed in the drive transmission mechanism 90 which transmits drive to the process cartridge 60, then it is possible to effectively suppress density non-uniformities occurring the image.

Furthermore, as described above, in the mechanism for transmitting drive to the process cartridge 60, there is a risk of density non-uniformities occurring in the image, even if only a slight rotational non-uniformity occurs. Consequently, it is desirable to be able to transmit drive to the process cartridge 60 by using the minimum necessary members. For example, in the developing unit 64, by transmitting drive to the developing roller 66 by a drive transmission member 71 which is supported on the projecting portion 52, it is thought that the number of components used in the process cartridge 60 can be reduced.

In this case, as shown in FIG. 5, a cutaway portion 54 is formed in the frame 51 and constitutes a positioning portion 53 by which the bearing 69 supporting the rotational shaft of the photosensitive drum 22 is positioned. When the drive coupling member 72 is disposed on the rotational center axis of the developing roller 66, the cutaway portion 54 and the projecting portion 52 overlap with each other in the frame 51, and therefore it is not possible to form a cylindrical projecting portion 52 in the frame 51. In the present embodiment, the drive coupling member 72 transmits drive to the supply roller 65 which is disposed at a position sufficiently distanced from the cutaway portion 54. Therefore, it is possible to support the drive coupling member 72 rotatably by the projecting portion 52.

As described above, in the first embodiment, the drive transmission mechanism has a frame including a positioning portion which positions the driven unit. The driving force transmission rotating body is supported rotatably by the circumferential surface provided in one portion of the frame. Consequently, it is possible to position the drive transmission mechanism accurately with respect to the driven unit. By suppressing rotational non-uniformity of the rotating bodies used in the driven unit, density non-uniformity in the image formed on the recording material is suppressed.

Furthermore, in the present embodiment, the end portion of the driving force transmission rotating body on the side of the driving force receiving portion is positioned further towards the driving force receiving portion than the front end of the projecting portion on the side of the driving force receiving portion, in the direction of the rotational center axis of the driving force transmission rotating body. Consequently, even if the driven unit is removed from the image forming apparatus, it is still possible to prevent the user from directly contacting the projecting portion, and therefore injury to the user due to touching the projecting portion can be suppressed.

Furthermore, in the present embodiment, the frame is made from a metallic material. Since metal has a high thermal conductivity, then even if heat of friction occurs between the driving force transmission rotating body and the projecting portion, it is possible to radiate the heat of friction by means of the metal frame.

In the present embodiment, the circumferential surface 52*s* of the projecting portion was a cylindrical surface which is circular in the whole of the circumferential direction, but it is also possible to adopt a configuration in which the circumferential surface 52*s* centered on the rotational center axis 72A is formed only in a portion of the circumferential direction, such that the circumferential surface 52s can rotatably support the drive coupling member 72.

(Second Embodiment)

Figure 6:
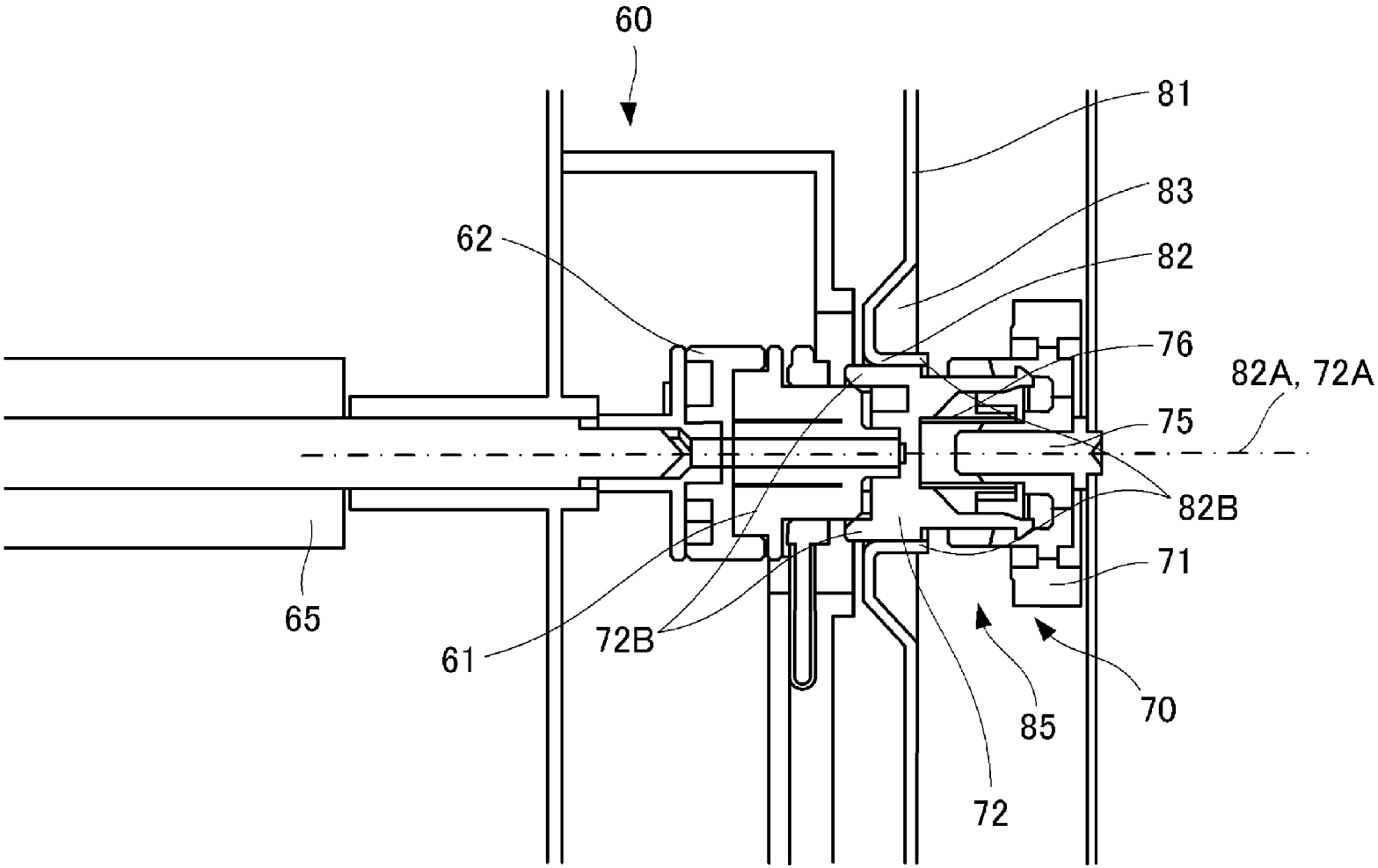
FIG. 6 is a cross-sectional drawing illustrating a mechanism for transmitting driving force to the process cartridge according to a second embodiment.
Figure 7:
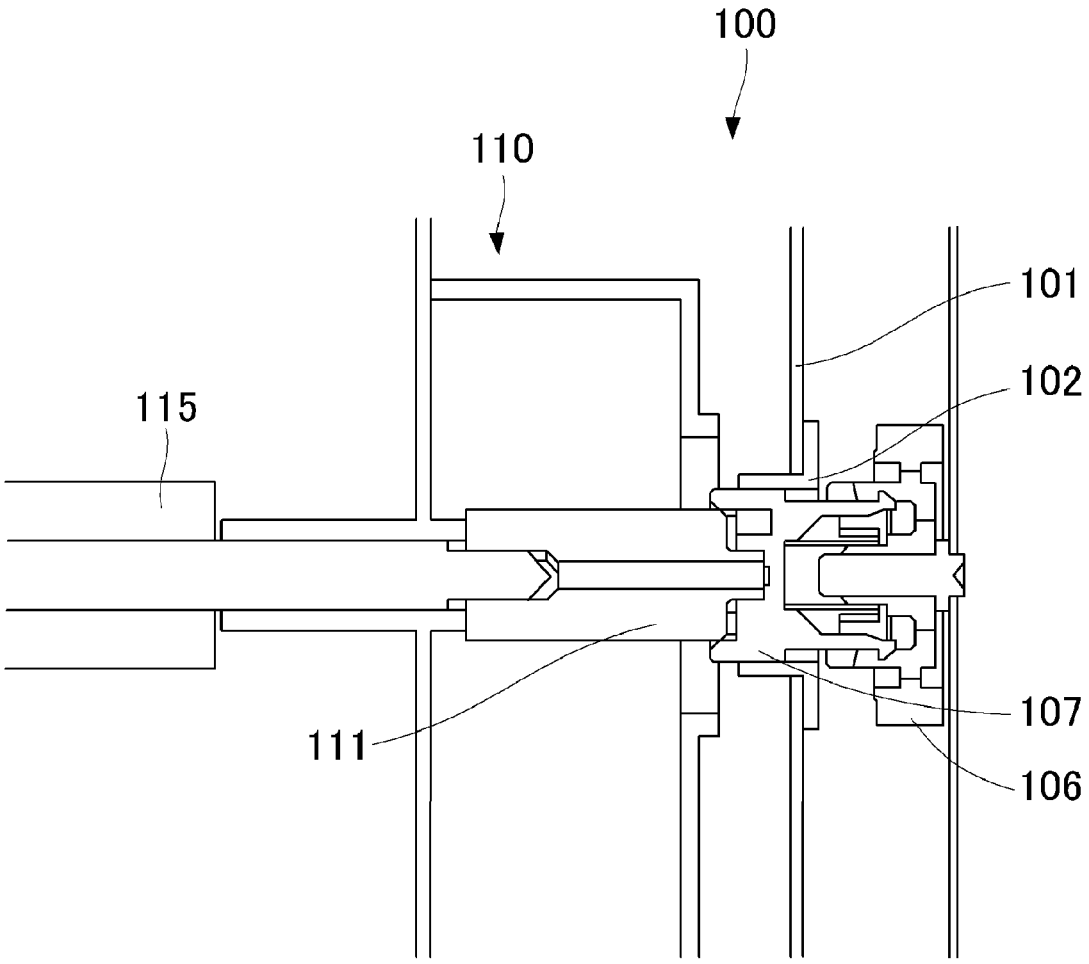
FIG. 7 is a cross-sectional drawing illustrating a mechanism for transmitting driving force to the process cartridge according to the prior art.

Next, a second embodiment will be described with reference to FIG. 6. In the second embodiment, the shape of the projecting portion of the frame differs from the first embodiment. In the second embodiment, the portions which have the same functions as the first embodiment are labelled with the same reference numerals and description thereof is omitted here. In the present embodiment, in the drive transmission mechanism 85, a constricted portion 83 formed bya constricting process is provided on the frame 81 which is made from plate metal, and a cylindrical projecting portion 82 is formed in the vicinity of the center of the constricted portion 83. A circular circumferential surface 82*s* which is centered on a central axis 82A coinciding with the rotational center axis 72A is formed on the projecting portion 82, and the circular circumferential surface 82*s* rotatably supports the drive coupling member 72.

The constricted portion 83 is formed in a concave shape on the side where the process cartridge 60 is not disposed, and is formed in a convex shape on the side where the process cartridge 60 is disposed. In the present embodiment, the front end 82B of the projecting portion 82 in the direction of the central axis 82A of the cylindrical projecting portion 82 projects in the opposite direction from the side where the process cartridge 60 is disposed. The cylindrical projecting portion 82 supports the drive coupling member 72 in a rotatable fashion, similarly to the first embodiment.

As described above, in the second embodiment, it is possible to produce a similar beneficial effect to the first embodiment. Furthermore, in the second embodiment, the front end of the projecting portion is disposed at an end extending from the side where the driving force receiving portion is disposed, towards an opposite side to the side where the driving force receiving portion is disposed. Consequently, even ina state where the driven unit has been removed from the image forming apparatus, it is possible to prevent injury to the user due to touching the front end of the projecting portion.

In each of the embodiments, the cylindrical projecting portion does not necessarily have to be formed by a burring process. The cylindrical projecting portion may also be formed by a plasticizing process or extrusion process, or the like. There are no limitations on the configuration of the projecting part, provided that the projecting part is configured integrally with the frame, and is also capable of rotatably holding the driving force transmission rotating body.

Furthermore, in the present embodiment, the frame does not necessarily have to be made from metal. There are no limitations in particular on the material of the frame, provided that the material has high thermal conductivity and high rigidity.

In the respective embodiments, the driving force transmission rotating body which is supported rotatably on the projecting portion does not necessarily have to transmit drive to the process cartridge. For example, the driving force transmission rotating body supported rotatably by the projecting portion may also transmit drive to a driven unit, such as an intermediate transfer belt or fixing device. There are no limitations on the configuration of the driving force transmission rotating body, provided that the rotating body is capable of transmitting drive to the units to which drive is transmitted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-121163, filed Jun. 16, 2015, which is hereby incorporated by reference herein in its entirety.

What is claimed is:

1. An image forming apparatus in which a cartridge is attached and which forms an image on a recording material by transmitting a driving force to the cartridge, the image forming apparatus comprising:

a driving force transmission rotating body which transmits the driving force by engaging with a driving force receiving portion provided at a longitudinal end of the cartridge; and a frame, made from a metallic material, the frame having:

a main body portion, a contacting portion, connected to the main body portion, and configured to contact the cartridge to position the cartridge in the frame in a direction that is perpendicular to a longitudinal direction of the cartridge, a cylindrical projecting portion, formed by a burring process, the cylindrical projecting portion projecting towards the driving force receiving portion from the main body portion of the frame in the longitudinal direction of the cartridge, a central axis of the cylindrical projecting portion coinciding with a rotational center axis of the driving force transmission rotating body, and a circumferential surface,. provided on an inner circumferential surface of the cylindrical projecting portion, and rotatably supporting the driving force transmission rotating body by contacting the driving force transmission rotating body, wherein the contacting portion and the cylindrical projecting portion do not overlap in a plane that is perpendicular to the central axis of the cylindrical projecting portion.

2. The image forming apparatus according to claim 1, wherein an end portion of the driving force transmission rotating body, on a side of the driving force receiving portion, is positioned further towards the side of the driving force receiving portion than a front end of the cylindrical projecting portion, on the side of the driving force receiving portion, in a direction along the rotational center axis of the driving force transmission rotating body.

3. The image forming apparatus according to claim 1, wherein the cylindrical projecting portion has a front end configured to be closest to the driving force receiving portion of the cartridge.

4. The image forming apparatus according to claim 1, further comprising the cartridge including:

the drive receiving portion, a bearing member, and a supply member for supplying a developer to the bearing member wherein the driving force receiving portion is provided at a longitudinal end portion of the supply member.

5. The image forming apparatus according to claim 4, wherein the driving force receiving portion has a joint configured to transmit the driving force from the driving force transmission rotating body to the supply member when there is deviation between the rotational center axis of the driving force transmission rotating body and a rotational center axis of the supply member.

6. The image forming apparatus according to claim 1, wherein the driving force transmission rotating body is configured to move between a transmission position for transmitting the driving force by engaging with the driving force receiving portion, and a retracted position that is withdrawn from the transmission position in a direction away from the driving force receiving portion.

7. The image forming apparatus according to claim 6, wherein, when the driving force transmission rotating body is in the retracted position, an end portion of the driving force transmission rotating body, on a side closest to the driving force receiving portion, is positioned closer to the driving force receiving portion than a front end of the circumferential surface on the side of the driving force receiving portion, in a direction of the rotational center axis of the driving force transmission rotating body.

8. The image forming apparatus according to claim 1, further comprising the cartridge including:

the drive receiving portion, a photosensitive drum on which a developer image is formed, and a bearing member which rotatably supports the photosensitive drum, wherein the contacting portion positions the cartridge by contacting the bearing member.

9. The image forming apparatus according to claim 1, wherein the cylindrical positioning portion is an edge of a cut-out portion of the frame.

10. The image forming apparatus according to claim 9, wherein the image is formed on the recording medium by a developer.

11. The image forming apparatus according to claim 1, wherein the frame is a plate-shaped metal member.

* * * * *